US005681227A

United States Patent [19]

Sayrizi

[11] Patent Number: 5,681,227

[45] Date of Patent: Oct. 28, 1997

[54] GOLF CLUB HEAD HAVING AIR-ACCOMMODATION PASSAGES

[76] Inventor: Donald Sayrizi, 1034 W. Kensington Rd., Los Angeles, Calif. 90026

[21] Appl. No.: 709,747

[22] Filed: Sep. 9, 1996

[51] Int. Cl.[6] ..... A63B 53/04

[52] U.S. Cl. ..... 473/327; 473/350

[58] Field of Search ..... 473/324, 327, 473/228, 219, 226, 328, 350, 345, 346

[56] References Cited

U.S. PATENT DOCUMENTS

| | | | |
|---|---|---|---|
| 3,003,768 | 10/1961 | Clements | 473/327 |
| 3,468,544 | 9/1969 | Antonious | 473/327 |
| 3,719,359 | 3/1973 | Evans | 473/328 |
| 4,065,133 | 12/1977 | Gordos | 473/328 |
| 4,681,321 | 7/1987 | Chen et al. | 473/346 |
| 4,828,265 | 5/1989 | Antonious | 473/327 |
| 4,869,508 | 9/1989 | Miller | 473/328 |
| 4,930,783 | 6/1990 | Antonious | 473/327 |
| 5,000,455 | 3/1991 | Beilfuss | 473/328 |
| 5,054,784 | 10/1991 | Collins | 473/327 |
| 5,158,296 | 10/1992 | Lee | 473/327 |
| 5,221,086 | 6/1993 | Antonious | 473/327 |
| 5,464,217 | 11/1995 | Shenoha | 473/328 |
| 5,529,303 | 6/1996 | Chen | 473/327 |

*Primary Examiner*—Sebastiano Passaniti
*Attorney, Agent, or Firm*—Erik M. Arnhem

[57] ABSTRACT

A golf club head having an array of closely spaced air holes spanning the ball striking area of the club head front wall produces reduced drag and greater club head speed. A series of upstanding vanes behind the front wall provide upwardly open air channels that minimize turbulence and vent air out of the club head, thereby further improving aerodynamic performances.

12 Claims, 1 Drawing Sheet

GOLF CLUB HEAD HAVING AIR-ACCOMMODATION PASSAGES

BACKGROUND AND SUMMARY OF THE INVENTION

This invention relates to a golf club head, and particularly to a golf head that has a porous striking face having an array of vaned geometric air passages acting as stabilizers, whereby the club head can move with greater velocity and stability and lessened air friction.

In recent years some golf club head designs have included air passages for achieving reduced air turbulence in the wake area behind the head. The aim is to provide greater club head velocity and longer driving distance.

U. S. Pat. No. 4,809,982, issued to M. Kobayashi on Mar. 7, 1989, shows a golf club head having one or more air passages located outside the ball striking area of the front face. As the club head moves during a ball-striking event, some of the air displaced by the club head is accommodated in the air passages, thereby somewhat reducing the air turbulence generated by the moving club head. However, the reduction in turbulence is relatively slight, as indicated by FIG. 4 of the Kobayashi patent.

U. S. Pat. No. 5,054,784, issued to F. Collins on Oct. 8, 1991, discloses a club head having a hollow interior chamber located between the front and rear wall areas of the head. Parallel horizontal slots are formed in the front and rear walls of the club head, such that during a ball-striking activity there is a relative air flow through the front slots, interior chamber and rear slots. A problem with Collin's patent arrangement is that the front slots create some turbulence in the air fed into the interior chamber, so that the air impacted against the rear slots is in a turbulent state. Such turbulent air has difficulty in getting through the rear slots, so inevitably a certain percentage of the air is taken along with the club head within the interior chamber. Such air movements represents lost energy that detracts from club head speed.

Collins shows an alternate arrangement (FIG. 4), wherein continuous slots extend from the front face of the club head to the rear face. A disadvantage of such elongated slots is that, due to the length of each slot, extensive skin friction causes air to adhere to the slot surface for a certain period of time. Considerable air turbulence is created in the wake area when the moving air leaves the slots to mix with relatively stagnant air behind the club head. The wake turbulence detracts from club head speed.

Lee U.S. Pat. No. 5,158,296 is another patent showing air passages extending through the club head. The Lee arrangement is thought to be generally similar to the aforementioned Kobayashi U.S. Pat. No. 4,809,982, as regards aerodynamic performance.

The present invention relates to a golf club head having an array of closely spaced air holes in the club front face. These air holes span substantially the entire ball-striking area of the club front face so that the club head has a comparatively small solid frontal area exposed to the stagnant air in the club head path. The club head passes readily through the air, with minimal air displacement and air turbulence.

The closely spaced air holes in the front face of the club head communicate with plural upwardly facing channels extending upwardly from the bottom wall of the club head. The channel walls support the club head front wall against deformation or fracture by the ball contact force. The channel walls act to aerodynamically stabilize the club head during the swing. The walls also interrupt and direct some of the air turbulence generated by the air holes in club head front face. Air turbulence is directed away from the club head bottom wall (sole) and out of the path of the club head, thus considerably reducing wake turbulence. The turbulence reduction, coupled with the reduced air displacement, contributes to lesser energy losses, with commensurate increase in club head stability and speed.

Further features of the invention will be apparent from the attached drawings and description of an illustrative embodiment of the invention.

It should be noted that this invention, instead of having air forced around the club heads (traditionally), now permits or allows all (most) of the air to flow in an uninterrupted path DIRECTLY THROUGH the club head during the swing. This allows a significant increase in speed due to less drag and air turbulence. It also allows a significant increase in club head stability due to the vaned air passages which act in part as miniature wings stabilizing the club head during the swing.

THE DRAWINGS

FIG. 5 shows an "iron " club whereas FIG. 3 illustrates a "metal wood " club.

DESCRIPTION OF A PREFERRED EMBODIMENT OF THE INVENTION

Figure 1:
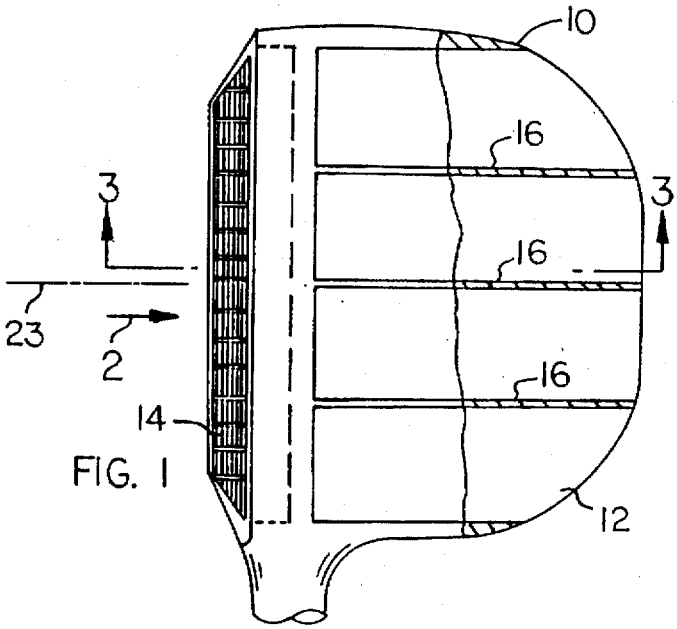
FIG. 1 is a top plan view of a golf club head embodying the invention, with selected areas being shown in section.
Figure 3:
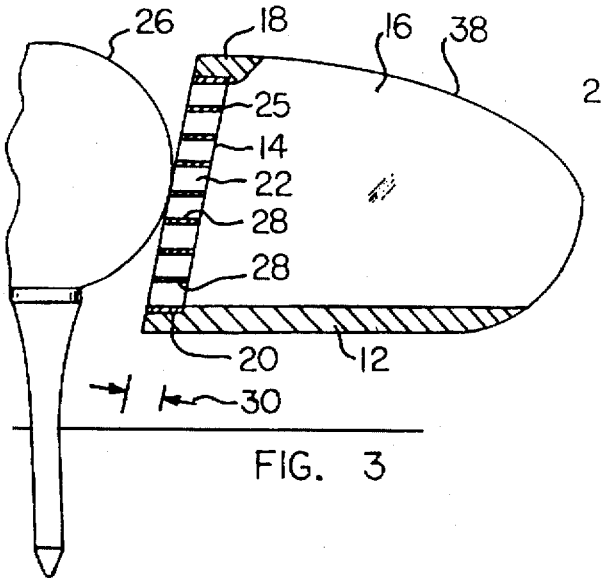
FIG. 3 is a sectional view taken on line 3—3 in FIG. 1.

FIGS. 1 and 3 show a golf club head that comprises a club head body 10 having a bottom wall (or sole) 12, upright porous front striking wall 14, and a series of parallel upright partition walls (or vanes) 16 connected to bottom wall 12.

As shown in the drawings, front wall 14 comprises an annular frame 18 integral with bottom wall 12 and vanes 16, and an apertured insert 20 fitting within the frame. The front edges of vanes 16 abut the rear face of apertured insert 20, to provide support against fracture or deformation of the insert by ball contact forces. Apertured insert 20 has an egg crate construction that provides an array of air openings 22 substantially completely spanning the ball-striking surface of the club head front wall.

The apertured insert 20 could be integral with frame 18 (to provide a one piece club head body). However, the separate frame-insert arrangement is preferred for manufacturing reasons, and also possibly for reasons of cost and impact resistance. The club head body can be formed of a material selected primarily for weight considerations, i.e. a high density material. The apertured insert (wall) 20 can be formed of a higher cost material, e.g. titanium, selected for its hardness, impact resistance and strength.

Wall 20 constitutes the ball striking surface. In the drawing the ball striking axis (at the ball contact point) is represented by numeral 23. At the ball contact point in the pendulum motion of the club head, the bottom wall 12 will be below the ball strike axis, whereas vanes 16 will be vertical or upright, in planes paralleling the ball strike axis. The terms "bottom", "front", and "vertical " are used to reference the orientations of the club head components at the ball contact point. However, it will be appreciated that the components will have different orientations at other points in the golf swing. Terms are used to facilitate an understanding of the invention.

Figure 6:
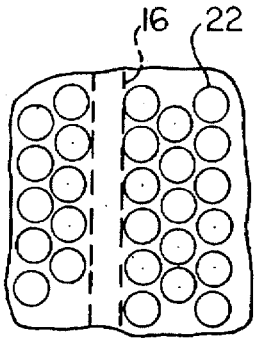
FIG. 6 is a fragmentary view showing an alternate air hole arrangement that can be used in the club heads depicted in FIGS. 1, 2, 3 and 5.
Figure 2:
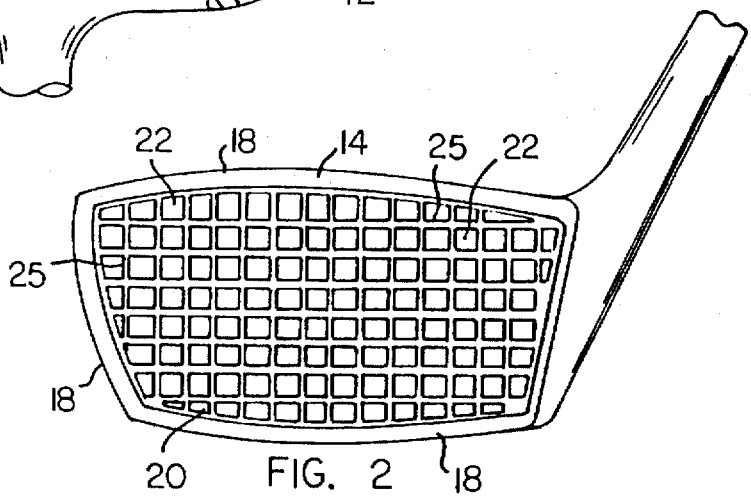
FIG. 2 is a front view of the FIG. 1 golf club head, taken in the direction of arrow 2 in FIG. 1.

Front wall 14 has a relatively large number of aerodynamically vaned air holes or openings 22. Each hole is separated from an adjacent hole by a relatively thin wall 25. As shown in the drawing, each air opening has a square configuration (as seen in FIG. 2). However, other hole configurations can be use, e.g. round or hexagonal. FIG. 6 fragmentarily shows an arrangement wherein the air holes are round.

Assuming a square hole configuration, as shown in FIG. 2, each hole can have a transverse dimension of about four millimeters, and an associated separator wall thickness of about one millimeter. The four millimeters is taken along any one of the four hole edges.

With the above dimensions, the total air opening area (the sum of the hole 22 spaces) is greater than fifty percent of the ball striking surface, i.e. the face area of insert 20. This is advantageous in that the club head is enabled to pass freely through the stagnant air, with minimal displacement of air and minimal air turbulence. In the best case condition there is no air movement, air displacement, or air turbulence. While such a condition is not possible, the illustrated club head construction achieves a considerable reduction in air displacement, air movements and air turbulence while maintaining relative directional stability.

Figure 4:
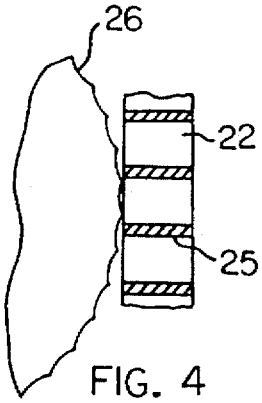
FIG. 4 is an enlarged fragmentary sectional view showing the front wall of the FIG. 1 club head in contact with a conventional golf ball.

The four millimeter hole size is selected partly to preserve ball direction consistency. As shown in FIG. 4, when the club face strikes a conventional dimpled golf ball 25 (having a diameter of about 1.7 inch) at least one of the separator walls 25 will be at or very close to the ball strike axis passing through the geometrical center of the ball. The ball flight direction will be relatively consistent, from one ball strike action to the next ball strike action.

Each air opening 22 has side surfaces 28 that are generally parallel to the sole wall 12 (in the front-to-rear direction) and ball strike axis 23. This is to enable the associated separator walls 25 to slice cleanly the through the stagnant air, with minimal obliqueness or air impact action. The aim is to minimize the generation of air turbulence in or behind the air openings 22.

Figure 7:
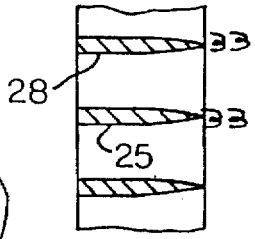
FIG. 7 is a fragmentary view illustrating air turbulence patterns generated by air holes (openings) in the club head front wall.

FIG. 7 shows one way of reducing air turbulence, to a certain extent. The trailing edges of each separator wall 25 are tapered to a knife edge condition, whereby the boundary air layers in adjacent openings 22 have turbulences that oppose each other, to achieve at least partial cancellation of the turbulences. A contributing factor to this turbulent cancellation effect is the relatively small wall thickness of each separator wall 25 (preferably only about one millimeter).

The wall thickness dimension 30 of apertured insert 20 (FIG. 3) is selected primarily on the basis of the impact strength and deformation resistance of the material used to form hole separator walls 25. With certain materials, e.g. titanium or high strength fiber composites, the wall thickness dimension can be relatively small, e.g. about seven millimeters (approximately one fourth inch).

The wall thickness dimension 30 is also affected to some extent by the number of vanes 16. Each vane has a leading edge abutting (or joined to) front wall 14, such that each vane absorbs some of the ball contact force. When a large number of vanes 16 are used the wall 14 thickness can be reduced somewhat. Vanes 16 form upwardly open channels communicating with the small air openings in front wall 14, whereby forward movement of the club head transfers air from openings 22 into the channel spaces 36. The primary purpose of vanes 16 is to stiffen and structurally reinforce the club head. However, the vanes also prevent transverse turbulence to some extent. Sole 12 acts as a floor, whereby the turbulence is directed upwardly out of the club head, i.e. across the upper edges 38 of vanes 16.

The upwardly-directed turbulence (or expansion) of the relatively stagnant air gets the turbulent air above the path of the club head, such that there is relatively little turbulence in the wake area behind the club head. Air above the vane edges 38 apparently draws (induces) turbulence out of the channel spaces 36. The "roofless " club head structure provided by vanes 16 is believed to have aerodynamic advantages over club heads having roofed chambers, as for example shown in U. S. Pat. No. 5,054,784 to F. Collins.

Vanes 16 are preferably spaced so that each of the interior vanes aligns with a row of hole separator walls 25 in front of wall 14. Each vane can have a wall thickness the same, or slightly greater than, the thickness of walls 25, whereby holes 22 can maintain a small hole spacing across the front wall 14. A small hole spacing maximizes the number of holes and the total hole area.

FIGS. 1 and 3 show the invention applied to a metal wood. FIG. 6 shows the invention applied to an iron, i.e. a club head having a greater angulation on the front face. The front wall construction in the FIG. 6 club head is similar to that of the front wall in the club head of FIGS. 1 and 3. Also, the FIG. 5 club head includes a number of parallel upright vanes 16, constructed generally similar to the vanes used in the club head depicted in FIGS. 1 through 3.

Figure 5:
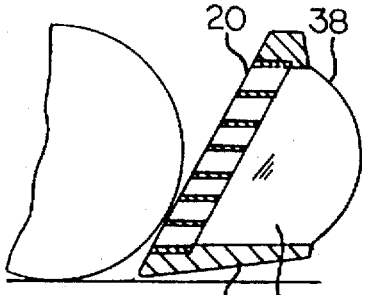
FIG. 5 is a view taken in the same direction as FIG. 3, but showing the invention embodied in a different club head.

FIG. 6 shows an alternate hole pattern that can be used in the front wall of either club head (FIG. 1 or FIG. 5). As shown in FIG. 6, the holes 22 are round, rather than square. Hexagonal holes can also be used. The holes can be arranged in separate groupings aligned with the different channel spaces formed by vanes 16, as shown generally in FIG. 6.

The club head of this invention is believed to offer superior aerodynamic performance that translates into a greater club head speed. The club head may also be advantageous as regards the ability to impart spin to the golf ball. AS shown in FIG. 6, the front edges of hole separator walls 25 exert a gripping action on the ball, that can produce ball spin. A further advantage of the illustrated club head is perimeter weighting. The vacant space above sole 12 causes the club head weight to be distributed to a large extent to the perimeter of the club head, i.e. along the sole and side edge of areas of the club head.

The drawings necessarily show specific embodiments of the invention. However, it will be appreciated that some variation in structure and configuration can be employed while still utilizing the teachings of the invention.

What is claimed is:

1. A golf club head comprising:

a head body having a sole wall, an upstanding front wall, and a plurality of parallel vanes extending upwardly from said sole wall;

said front wall having a front ball-striker surface, a rear surface, and an array of closely spaced air openings substantially completely spanning the ball-striker surface, each air opening extending from said ball-striker surface to said rear surface so as to communicate with vacant spaces formed by said parallel vanes;

said vanes being joined to the rear surface of said front wall, so that when the golf club head body is moving forwardly during a ball-striking activity the vanes form air-accommodation channels paralleling the direction of head body movement.

2. The golf club head of claim 1, wherein said air openings have side surfaces thereof paralleling said sole wall.

3. The golf club head of claim 1, wherein said air openings are formed by plural separator walls; each separator wall having a transverse thickness substantially less than the transverse dimension of the associated air openings.

4. The golf club head of claim 3, wherein each separator wall has a transverse thickness of about one millimeter, and each air opening has a transverse dimension of about four millimeters.

5. The golf club head of claim 1, wherein said front wall comprises an annular upright frame integral with said sole wall, and an apertured insert in said frame.

6. The golf club head of claim 1, wherein each vane has an exposed upper edge and an exposed rear edge.

7. The golf club head of claim 1, wherein the total air opening area is at least fifty percent of the ball-striker surface area.

8. The golf club head of claim 1, wherein said vanes are evenly spaced.

9. The golf club head of claim 1, wherein said head body has a length dimension in the direction of club head movement; said front wall having a thickness that is no greater than one quarter of the club head body length dimension.

10. The golf club head of claim 1, wherein said vanes are located in parallel vertical planes when the ball striker surface is in contact with a golf ball during a ball-striking activity.

11. The golf club head of claim 1, wherein each vane has two flat smooth parallel major surfaces.

12. A golf club head comprising:

a head body having a ball striking axis; said head body comprising a bottom wall, front wall, plural upper edges, and plural rear edges;

said front wall having an array of closely spaced air holes spanning the ball striking area of said front wall; and plural upstanding channel-forming walls connected to said bottom wall and said front wall; said channel-forming walls extending parallel to the ball striking axis to define the upper and rear edges of the club head body.

* * * * *